US005154089A

United States Patent [19]

Konishi

[11] Patent Number: 5,154,089

[45] Date of Patent: Oct. 13, 1992

[54] COAXIAL TYPE STARTER

[75] Inventor: Keiichi Konishi, Hyogo, Japan

[73] Assignee: Mitsubishi Denki K.K., Tokyo, Japan

[21] Appl. No.: 684,085

[22] Filed: Apr. 12, 1991

[30] Foreign Application Priority Data

May 15, 1990 [JP] Japan ..... 2-125809

[51] Int. Cl.[5] ..... F02N 11/00

[52] U.S. Cl. ..... 74/7 E; 74/7 A; 74/7 C

[58] Field of Search ..... 74/7 A, 7 C, 7 E

[56] References Cited

U.S. PATENT DOCUMENTS

| | | | |
|---|---|---|---|
| 4,464,576 | 8/1984 | Williams | 74/7 C X |
| 4,779,470 | 10/1988 | Morita et al. | 74/7 R |
| 4,918,324 | 4/1990 | Isozumi | 74/7 A X |
| 4,924,108 | 5/1990 | Isozumi | 290/48 |
| 4,926,706 | 5/1990 | Isozumi | 74/7 E X |
| 4,947,052 | 8/1990 | Isozumi | 74/7 C X |
| 4,987,786 | 1/1991 | Morishita et al. | 74/7 E X |
| 4,989,467 | 2/1991 | Morishita et al. | 74/7 C X |

FOREIGN PATENT DOCUMENTS

| | | | |
|---|---|---|---|
| 2626625 | 4/1989 | France . | |
| 57-165663 | 10/1982 | Japan | 74/7 E |
| 58-77165 | 5/1983 | Japan | 74/7 E |

*Primary Examiner*—Allan D. Herrmann
*Assistant Examiner*—Julie Krolikowski
*Attorney, Agent, or Firm*—Sughrue, Mion, Zinn, Macpeak & Seas

[57] ABSTRACT

In a coaxial type starter, the rear end portion of the clutch inner of its overrunning clutch is supported through a bearing on the front end portion of the armature rotary shaft, and the front end portion is supported through a bearing on the front bracket. Both end portions of the clutch outer are supported through bearings on the clutch inner, and the clutch outer is fitted into the cylindrical portion of the planetary gear frame in such a manner that the clutch outer and the cylindrical portion slide relative to each other when torque larger than a predetermined value is applied thereto. The clutch inner and the clutch outer are maintained coaxial at all times, and the clutch inner and the bearings or rollers are prevented from being abnormally worn out.

3 Claims, 2 Drawing Sheets

COAXIAL TYPE STARTER

BACKGROUND OF THE INVENTION

This invention relates to a coaxial type starter for starting an internal combustion engine in which an electromagnetic switch device is coupled to the rear of an electric motor section.

FIG. 2 is a longitudinal sectional view of a conventional coaxial type start disclosed, for instance, by Japanese Patent Application (OPI) No. 64260/1990 (the term "OPI" as used herein means an "unexamined published application). In FIG. 1, a DC motor 1 as follows: That is, the DC motor, as shown in FIG. 1, comprises: a yoke 2; field poles 3 mounted on the yoke (which are permanent magnets in this case); a rear bracket 4 on which brush holders 5 are mounted; and an armature 6. The armature 6 includes: an armature rotary shaft 7; an armature core 8 mounted on the rotary shaft 7; an armature coil 9 mounted on the armature core 8; and a commutator 10 which is fixedly mounted on the rotary shaft 7 and connected to the armature coil 9. The rear end portion of the rotary shaft 7 is supported through a bearing 11 on the rear bracket 4, and the front end portion is supported through a bearing 12 on a bearing supporting section which is integral with the front end portion of the yoke 2.

Further in FIG. 2, reference numeral 13 designates a front bracket connected to an internal gear frame 16 with bolts 14 which is coupled to the yoke 2.

The starter further includes a planetary gear speed reducer 15 which is constructed as follows. The internal gear frame 16 serves as an intermediate bracket, and has an internal gear 16*a* formed in the inner periphery. A sun gear 17 is formed on the front end portion of the rotary shaft 7. A plurality of planetary gears 18 engage with the sun gear 17 and the internal gear 16*a* in such a manner that they rotate and revolve. A planetary gear frame 19 is supported by a ball bearing 22 mounted on the front end portion of the rotary shaft 7. A plurality of supporting pins 20 are fixedly secured to the planetary gear frame 19, to support the planetary gears 18 through bearings 21, thus transmitting the speed reducing rotation due to the revolution of the planetary gears 18.

The planetary gear speed reducer 15 is coupled to an overrunning clutch 23 which is constructed as follows. A clutch outer 24 is coupled to the planetary gear speed reducer 15 in such a manner that its rear end portion is connected to the front end portion of the planetary gear frame 19 by shrinkage fitting. The clutch outer 24 is so designed that, when the torque exceeds a certain value, it slides relative to the planetary gear from 19 to release the impact. A clutch inner 25 is coupled through a plurality of rollers 26 to the clutch outer 24, to transmit rotation in one direction. The front end portion of the clutch inner 25 is supported through a ball bearing 29 on the inner cylindrical wall of the internal gear frame 16. The rear end of the clutch inner 25 is slightly spaced from the inner wall of the rear end portion so that the clutch inner is rotatable. The overrunning clutch 23 further includes a retaining plate 27 for preventing the rollers 26 from coming off, and a holding cap 28 fixedly secured to the outer cylindrical wall of the clutch outer 23 to hold the retaining plate 27.

An output rotary shaft 30 is supported by the armature rotary shaft 7 and the clutch inner 25 through sleeve bearings 31 and 32 in such a manner that it is rotatable and movable forwardly and backwardly. The output rotary shaft 30 has a helical spline 30*a* on its middle portion, which is engaged with a helical spline 25*a* formed in the inner cylindrical wall of the clutch inner 25 for transmission of rotation. A pinion 33 is spline- coupled to the front end portion of the output rotary shaft 30, and retained by a stopper 34. The pinion 33 is moved forwardly by the forward movement of the output rotary shaft 30, to engage the ring gear (not shown) of the engine to start the latter. A return spring 35 is provided to move the output rotary shaft 30 backwardly. A buffer spring 36 is employed to push the pinion 34.

An electromagnetic switch device 40 is coaxially coupled to the rear end portion of the DC motor 1. The electromagnetic switch device 40 is designed as follows. An exciting coil 41 is wound on a bobbin 42. A stationary iron core 43 is provided on the front end face of the exciting coil 41. A magnetic path case 44 covers the rear end face and the outer cylindrical wall of the exciting coil 41 and holds the stationary iron core 43, thus serving as a magnetic path core. A movable core 45 is inserted into the bobbin 42 in such a manner that it is movable back and forth, and it is confronted with the rear end face of the stationary core 43. A pair of stationary contacts 46 are supported on the rear bracket 4 in such a manner that they are electrically insulated from the latter 4. One of the stationary contacts 46 is connected to a terminal bolt 47, which is connected through a lead wire to a power source (or battery). The movable core 45 serving as a plunger is connected to a hollow rod 48. The hollow rod 48 supports a movable contact 49 through an insulator in such a manner that the movable contact 49 confronts with the pair of stationary contacts 46. That is, the movable contact 49 is moved together with the movable core, to make in contact with the pair of stationary contacts 46. A compression spring 50 is provided to apply a contact pressure to the movable contact 49. The hollow rod 48 is coupled to a push rod 51 in such a manner that the push rod 51 is axially movable with its rear end portion inserted into the hollow rod 48. The push rod 51, being pushed by a coil spring 51, is moved forwardly as the movable core 45 moves forwardly, so as to push the output rotary shaft 30 forwardly through a steel ball 53. A coil spring 54 is provided to hold the steel ball 53 in the hole formed in the rear end portion of the output rotary shaft 30. A cover 55 made of non-magnetic material is coupled to the magnetic path case 44.

Further in FIG. 2, through-bolt 56 is screwed into the internal gear frame 16 through the cover 55, the stationary core 43, the rear bracket 4, and the yoke 2.

The operation of the conventional coaxial type starter will be described.

When the start switch of the engine is turned on, the exciting coil 41 is energized, so that the movable core 45 is attracted by the stationary core 43. As a result, the push rod 51 is moved forwardly to cause the pinion 33 to engage with the ring gear of the engine. At the same time, the movable contact 49 is brought into contact with the pair of stationary contacts 46, to energize the armature coil 9, so that the armature 6 starts rotation. The speed of rotation of the armature rotary shaft 7 is reduced by the planetary gear speed reducer 15, and applied through the overrunning clutch 23 and the output rotary shaft 30 to the pinion 33, thereby to start the engine.

When the start switch is turned off after the engine has been started, the exciting coil 41 is deenergized. As a result, the output rotary shaft 30 is moved backwardly by the return spring 35, and accordingly the pinion 33 is disengaged from the ring gear of the engine. As the output rotary shaft 30 is moved backwardly, the movable core 45 is also moved backwardly with the aid of the push rod 51, so that the movable contact 48 is disconnected from the pair of stationary contacts 46.

In the above-described conventional coaxial type starter, the clutch outer 24 of the overrunning clutch 23 is fitted on the planetary gear frame 19 supported by the ball bearing 22 in such a manner that it slides when abnormal torque occurs, while the clutch inner 25 is supported by the ball bearing 29 at the front end, and the front end portion of the clutch outer 24 is engaged with the rear end portion of the clutch inner 25 through the rollers 26.

Therefore, under the so-called "overrunning condition" that the pinion 33 is driven by the engine, the rollers 26 are idle, and the centrifugal force applied to the whole overrunning clutch 23 and the decrease in the force of coupling the clutch outer 24 and clutch inner 25 cause the latter 24 and 25 to operate independently of each other or rotate eccentrically.

As a result, the clutch outer 24 and the clutch inner 25 are each supported at one end, so that the ball bearings 22 and 29, which support the clutch outer 24 and the clutch inner 25, respectively, suffer from great moment loads, which will greatly reduce the service lives thereof. Furthermore, if the centrifugal force applied to the overrunning clutch 23 exceeds the allowed value, the clutch is internally twisted, so that the rollers 26 and the clutch inner 25 may be abnormally worn out.

SUMMARY OF THE INVENTION

Accordingly, an object of this invention is to eliminate the above-described difficulties accompanying a conventional coaxial type starter.

More specifically, an object of the invention is to provide a coaxial type starter in which the clutch outer and the clutch inner of its overrunning clutch are each supported through bearings at both ends, whereby the difficulty is eliminated that, in the conventional coaxial type starter, the bearings, the rollers and the clutch inner are abnormally worn out because the clutch inner and the clutch outer are each supported at one end. Accordingly, the service life is lengthened as much.

The foregoing object and other objects of the invention has been achieved by the provision of a coaxial type starter including an electric motor with a hollow armature rotary shaft, an output rotary shaft which includes a rear end portion inserted into the armature rotary shaft, and a front end portion on which a pinion is mounted in such a manner that the pinion is engaged with an engine ring gear when moved forwardly an electromagnetic switch device coaxially coupled to the rear end portion of the electric motor. The electromagnetic switch device has an exciting coil which, when electrically energized, causes a stationary core to attract a movable core, so that the output rotary shaft is moved forwardly through a push rod while a movable contact is placed in contact with a pair of stationary contacts to electrically energize the electric motor thereby to rotate the armature rotary shaft. A planetary gear speed reducer is arranged in front of the electric motor, the planetary gear speed reducer reduces the rotation of the armature rotary shaft which is transmitted through a planetary gear frame. An overrunning clutch including a clutch outer and a clutch inner, is coupled to the front end portion of the planetary gear frame to transmit the reduced rotation to the output rotary shaft and a front bracket is coupled to the front end portion of the electric motor in such a manner as to accommodate the planetary gear speed reducer and the overrunning clutch.

According to the invention, the clutch outer of the overrunning clutch is fitted into the cylindrical portion of the planetary gear frame in such a manner that the clutch outer and the cylindrical portion slide relative to each other when torque larger than a predetermined value is applied thereto. The rear end portion of the clutch inner is supported through a bearing on the front end portion of the armature rotary shaft, while the front end portion is supported through a bearing on the inner wall of the front end portion of the front bracket, and the front end portion and the rear end portion of the clutch outer are supported through bearings on the clutch inner.

The nature, principle and utility of the invention will become more apparent from the following detailed description when read in conjunction with the accompanying drawings, in which like parts are designated by like reference numerals or characters.

DETAILED DESCRIPTION OF THE INVENTION

A preferred embodiment of a coaxial type starter according to this invention will be described with reference to FIG. 1. The upper half of FIG. 1 shows the output rotary shaft of the starter which has been moved forwardly, and the lower half shows the output rotary shaft which has been moved backwardly.

The parts of the coaxial type starter will be described which have been improved according to the invention and accordingly are different from those of the above-described conventional coaxial type starter.

Figure 1:
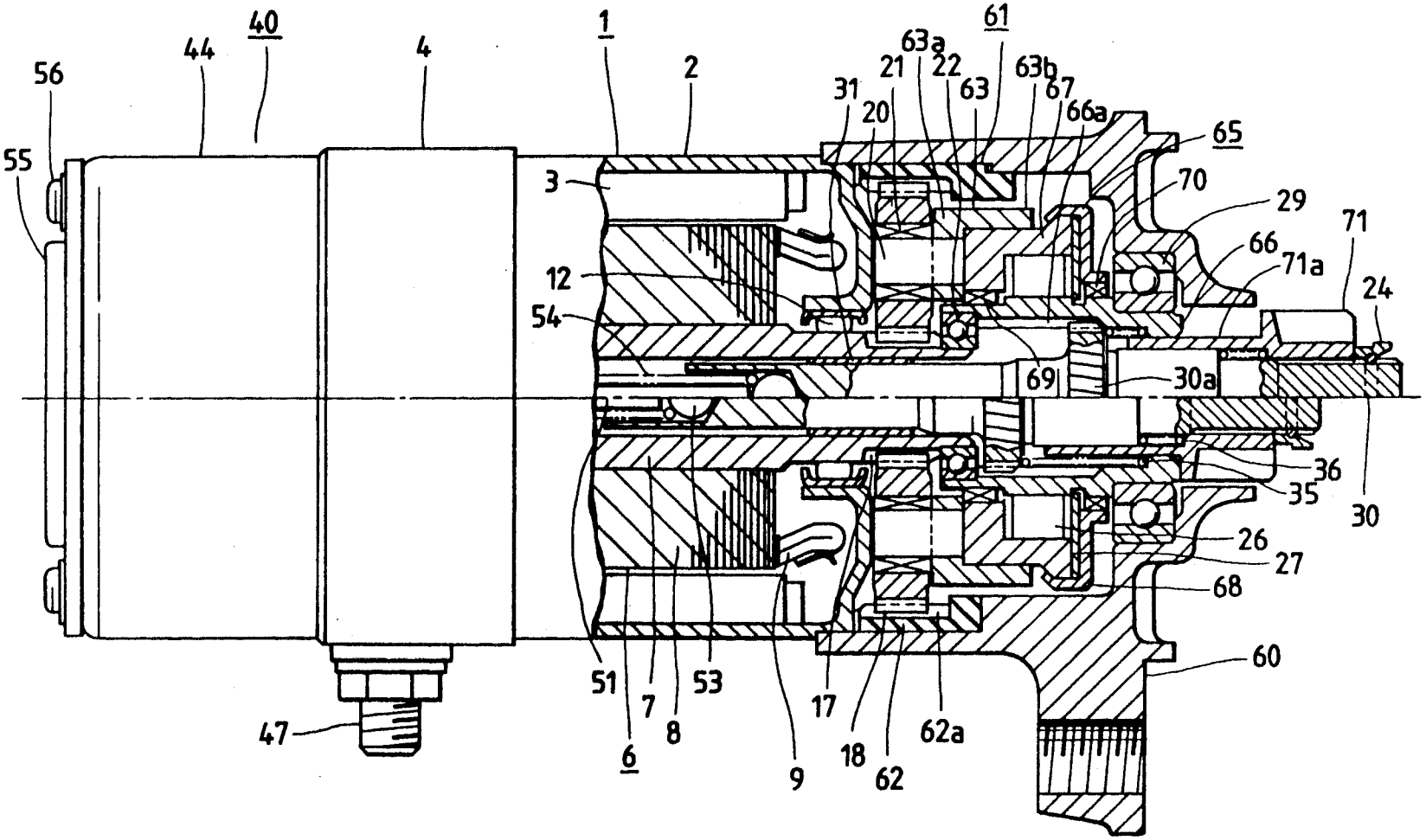
FIG. 1 is a longitudinal sectional diagram showing essential components of a preferred embodiment of a coaxial type starter according to this invention, which in the upper and lower halves the output rotary shaft of the starter which is moved forwardly and backwardly respectively.
Figure 2:
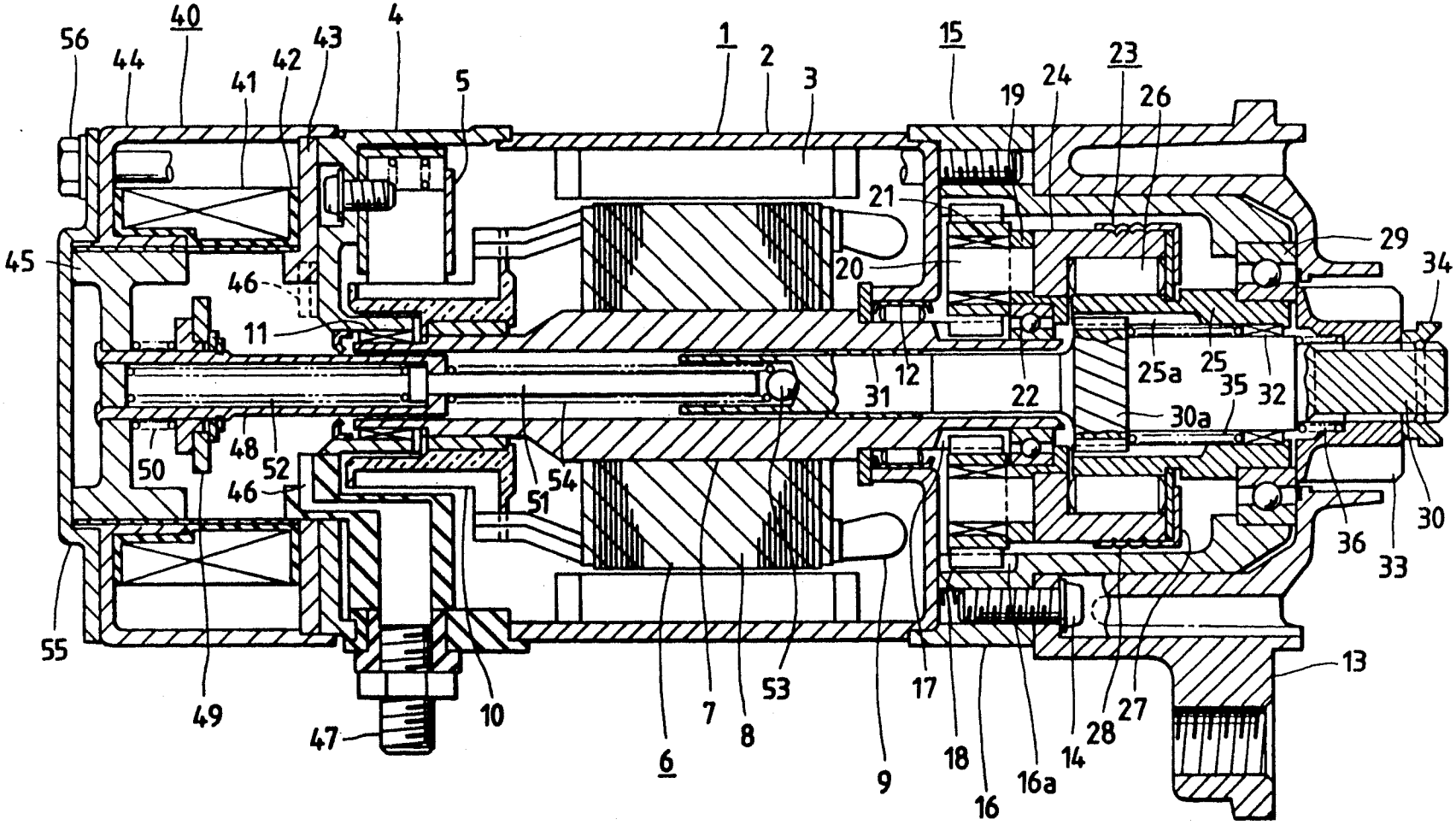
FIG. 2 PRIOR ART
FIG. 2 is a longitudinal sectional diagram showing a conventional coaxial type starter.

As shown in FIG. 1, the coaxial type starter has a front bracket 60 connected to the yoke 2 with a through bolt 56.

The starter further has: planetary gear speed reducer 61 which includes an internal gear frame 62 secured to the front bracket 60. The internal gear frame 62 has an internal gear **62*a*. The internal gear frame 62 is made of a reinforced synthetic resin. However, the internal gear frame 62 may be made of a metal material. The planetary gear speed reducer 61 further includes a planetary gear frame 63 which is made up of an annular portion 63*a* and a cylindrical portion 63*b* extended from the outer periphery of the annular portion 63*a*. A plurality of supporting pins 20 embedded in the annular portion 63*a* support planetary gears 18 through bearings 21**.

The starter further includes an overrunning clutch 65 which is designed as follows. The overrunning clutch 65 includes a clutch inner 66 which is supported at both ends. That is, the rear end portion of the clutch inner 66 is supported through a ball bearing 22 on the armature rotary shaft 7, while the front end portion is supported through a ball bearing 29 on the inner wall of the front end portion of the bracket 60 described above. The inner cylindrical wall of the clutch inner 66 is formed into a helical spline 66*a*, which is engaged with the helical spline 30*a* formed on the output rotary shaft 30. The overrunning clutch 65 further includes a clutch outer 67 which is also supported at both ends. The rear end portion of the clutch outer 67 is supported through a bearing 69 on the clutch inner 66. A plurality of rollers 26 are arranged between the clutch inner 66 and the clutch outer 67. A holding cap 68 is secured through the retaining plate 27 to the outer cylindrical wall of the clutch outer 67 by staking, and is supported through a bearing 70 on the clutch inner 66. That is, the clutch outer 67 is supported through the bearings 69 and 70 on the clutch inner 66 at both ends. The cylindrical portion of the clutch outer 67 is shrinkage-fitted into the cylindrical portion 63*b* of the planetary gear frame 63 in such a manner that, when torque larger than a predetermined value is applied thereto, the clutch outer 67 and the planetary gear frame 63 slide relative to each other, thereby to lessen the impact load.

A pinion 71 is mounted on the output rotary shaft 30 in such a manner that it is axially slidable. More specifically, the pinion 71 includes a cylindrical portion 71*a* extended backwardly which slides on the output rotary shaft 30.

The other components of the coaxial type starter are similar to those in the above-described conventional coaxial type starter.

As was described above, in the coaxial type starter of the invention, the clutch inner 66 of the overrunning clutch 65 is supported through the ball bearings 22 and 29 at both ends, while the clutch outer 67 is supported through the bearings 69 and 70 at both ends. Hence, during overrunning, the clutch outer 67 and the clutch inner 65 are held coaxial, and therefore the bearings and other coupling members are prevented from being abnormally worn out.

In the above-described coaxial type starter, the stationary contacts and the movable contact are provided inside the exciting coil. However, these components may be arranged behind the magnetic path core.

Effects of the invention

In the coaxial type starter according to the invention, the rear end portion of the clutch inner of the overrunning clutch is supported through the bearing on the front end portion of the armature rotary shaft and the front end portion is supported through the bearing on the inner wall of the front end portion of the front bracket, while the front end portion and the rear end portion of the clutch outer are supported through the bearings on the clutch inner. Furthermore, the clutch outer is fitted into the cylindrical portion of the planetary gear frame in such a manner that when an impact load is applied to cause torque larger than the predetermined value, the clutch outer and the planetary gear frame slide relative to each other. Therefore, the clutch outer and the clutch inner are maintained coaxial at all times, which prevents the bearings and other coupling members from being abnormally worn out.

While there has been described in connection with the preferred embodiment of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A coaxial type starter including:

an electric motor having a hollow armature rotary shaft;

an output rotary shaft which includes a rear end portion inserted into side armature rotary shaft, and a front end portion on which a pinion is mounted in such a manner that said pinion is engaged with an engine ring gear when said pinion is moved in a forward direction;

an electromagnetic switch device coaxially coupled to a rear end portion of said electric motor, said electromagnetic switch device comprising an exciting coil fixed to said motor so as to cause a stationary core fixed to said coil to attract a movable core which is coupled to said output rotary shaft by a push rod so that said output rotary shaft is moved forwardly when said coil is energized, a movable contact being coupled to said movable core so as to be placed in contact with a pair of stationary contacts when said coil is energized to electrically energize said electric motor thereby to rotate said armature rotary shaft;

a planetary gear speed reducer coupled to said electric motor, so as to reduce the rotation of said armature rotary shaft which is transmitted through a planetary gear frame of said planetary gear speed reducer;

an overrunning clutch including a clutch outer member and a clutch inner member, said overrunning clutch being coupled to a front end portion of said planetary gear frame to transmit the rotation thus reduced to said output rotary shaft; and a front bracket coupled to a front end portion of said electric motor in such a manner as to accommodate said planetary gear speed reducer and said overrunning clutch, said clutch outer member being fitted into a cylindrical portion of said planetary gear frame in such a manner that said clutch outer member and said cylindrical portion slide relative to each other when a torque larger than a predetermined value is applied thereto, said clutch inner member having a rear end portion which is supported through a first bearing on a front end portion of said armature rotary shaft and a front end portion which is supported through a second bearing on an inner wall of a front end portion of said front bracket, and said clutch outer member having a front end portion and a rear end portion which are respectively supported through third and fourth bearings on said clutch inner member.

2. A coaxial type starter according to claim 1, in which said overrunning clutch further comprises:

a plurality of rollers arranged between said clutch inner member and said clutch outer member;

a retaining plate fixed to said clutch outer member and positioned so as to maintain a position of said rollers; and a holding cap secured, to an outer cylindrical wall of said clutch outer member, said holding cap being supported through said fourth bearing on said clutch inner member.

3. A coaxial type starter according to claim 1, in which said first through fourth bearings are ball bearings.

* * * * *